US011774074B2

(12) United States Patent
Jiang

(10) Patent No.: US 11,774,074 B2
(45) Date of Patent: Oct. 3, 2023

(54) LOW-NOISE RESET CONTROL SYSTEM OF LIGHT FIXTURE

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/588,744

(22) Filed: Jan. 31, 2022

(65) Prior Publication Data

US 2022/0205620 A1 Jun. 30, 2022

Related U.S. Application Data

(63) Continuation of application No. PCT/CN2021/108662, filed on Jul. 27, 2021.

(30) Foreign Application Priority Data

Dec. 31, 2020 (CN) ..... 202011634808.7

(51) Int. Cl.
*F21V 21/15* (2006.01)
*F21V 21/30* (2006.01)
*F21V 14/02* (2006.01)

(52) U.S. Cl.
CPC ..... *F21V 21/15* (2013.01); *F21V 14/02* (2013.01); *F21V 21/30* (2013.01)

(58) Field of Classification Search
CPC ..... F21V 21/15; F21V 21/30; F21V 14/02
See application file for complete search history.

(56) References Cited

U.S. PATENT DOCUMENTS 9,539,952 B2 * 1/2017 Gebhard ..... F21V 5/04
2009/0251905 A1 10/2009 Melzner et al.

FOREIGN PATENT DOCUMENTS

| | | | |
|---|---|---|---|
| CN | 101178533 A | | 5/2008 |
| CN | 207179373 U | | 4/2018 |
| CN | 207334386 U | * | 5/2018 |
| CN | 207334386 U | | 5/2018 |
| CN | 111594808 A | | 8/2020 |
| CN | 212029431 | | 11/2020 |
| CN | 112648588 A | | 4/2021 |
| EP | 2711624 A1 | | 3/2014 |

* cited by examiner

*Primary Examiner* — Anabel Ton
(74) *Attorney, Agent, or Firm* — Muncy, Geissler, Olds & Lowe, P.C.

(57) ABSTRACT

A low-noise reset control system of a light fixture includes a supporting member, a pivoting member and a driver. A limiting portion is arranged on the pivoting member, A blocking portion for limiting a rotation angle of the pivoting member is arranged on the supporting member. The system further includes an angle detector for sensing rotation angle of the pivoting member and an angle indicator for sending out indication signal when the pivoting member is at a specific angular position. In a reset process, when the pivoting member rotates in a forward direction until the limiting portion is blocked by the blocking portion, the driver brakes immediately and drives the pivoting member to rotate by a certain angle in a reverse direction at low speed, then to increase speed and continue to drive the pivoting member to rotate in the reverse direction to look for a relative initial position.

20 Claims, 5 Drawing Sheets

LOW-NOISE RESET CONTROL SYSTEM OF LIGHT FIXTURE

CROSS REFERENCE TO RELATED APPLICATIONS

The present application is a continuation of International Application No. PCT/CN2021/108662, filed on Jul. 27, 2021, which claims priority from Chinese Patent Application No. 202011634808.7 filed on Dec. 31, 2020, all of which are hereby incorporated herein by reference.

TECHNICAL FIELD

The present invention relates to the technical field of stage lights, and more particularly, relates to a low-noise reset control system of a light fixture.

BACKGROUND

A stage light fixture generally includes a supporting arm pivoted to a light base and a light head pivoted to the supporting arm. When the stage light fixture conducts a power-on reset or a reset during work, the light head and/or the supporting arm needs to return to zero to determine an initial position. What's more, a mechanical limiting structure is provided in both clockwise and counterclockwise rotation directions to prevent that the stage light fixture infinitely rotates and consequently internal electronic wires are twisted off.

According to existing technologies, when the light head and the supporting arm of the stage light fixture are reset, the light head and the supporting arm will be firstly rotated in a specified direction until the light head and the supporting arm touch the limiting structure and stop rotating. At this moment, driving motor shafts of the light head and the supporting arm cannot continue to rotate, then a feedback device cannot normally feedback a signal. When the system does not receive a normal signal from the feedback device, it is thus determined that the light fixture has reached a limiting position of the limiting structure, and this position is defined as the initial position.

However, such reset method has a relatively obvious defect. Due to large mass of the light head and the supporting arm, when colliding with the limiting structure at a certain speed, the light head and the supporting arm will be rebounded back, and then under action of driving motors, they will collide with the limiting structure again, and then be rebounded back again, such process is repeated many times, which causes quite clear noise of "click, click, click . . . ".

SUMMARY OF THE INVENTION

The present invention thus provides a low-noise reset control system of a light fixture, which can lower noise as much as possible during reset, and can avoid that a limiting portion and a blocking portion collide with each other many times.

According to the present invention, the low-noise reset control system includes a supporting member, a pivoting member pivoted to the supporting member, and a driver driving the pivoting member to rotate relative to the supporting member. The pivoting member includes at least one light source for generating a lighting effect. A limiting portion is arranged on the pivoting member, and a blocking portion matched with the limiting portion to limit a rotation angle of the pivoting member is arranged on the supporting member. The low-noise reset control system further comprises an angle detector that senses a rotation angle of the pivoting member and an angle indicator that sends out an indication signal when the pivoting member is at a specific angular position relative to the supporting member, and when the pivoting member rotates by one circle relative to the supporting member, the angle indicator sends out the indication signal only once. In a reset process of the light fixture, when the pivoting member rotates in a forward direction until the limiting portion is blocked by the blocking portion, the driver brakes immediately, and after the pivoting member is driven to rotate by a certain angle in a reverse direction at a low speed, then the speed is increased to continue to drive the pivoting member to rotate in the reverse direction to look for a relative initial position.

The low-noise reset control system according to the present invention determines an absolute initial position through cooperation of the limiting portion and the blocking portion, and then confirms the relative initial position using the angle indicator. A rotation angle of the pivoting member is recoded through the angle detector. When the pivoting member rotates in the forward direction until the limiting portion is blocked by the blocking portion, the driver brakes immediately, so that a rotation speed of the pivoting member decreases to avoid that the limiting portion repeatedly collides with the blocking portion to cause noise. Then the pivoting member is driven to rotate by a certain angle in the reverse direction at a low speed so that a transmission member between the driver and the pivoting member is loosened and vibration of the pivoting member is weakened to avoid inaccurate positioning in looking for the relative initial position later, and then the speed is increased to continue to drive the pivoting member to rotate in the reverse direction to look for the relative initial position so as to complete reset of the light fixture, which is free of noise emitted during repeated collisions and can also ensure the positioning accuracy of the initial position.

After the driver brakes immediately, the pivoting member is driven to rotate by a certain angle in the reverse direction until the pivoting member is stationary, and then it continues to drive the pivoting member to rotate in the reverse direction to look for the relative initial position. With such configuration the transmission member between the driver and the pivoting member is completely loosened and the vibration of the pivoting member is completely dissipated, ensuring more accurate positioning in looking for the relative initial position of the pivoting member later.

According to the present invention, when power-on reset is conducted, the pivoting member rotates in the forward direction until the limiting portion is limited by the blocking portion, then the driver brakes and drives the pivoting member to rotate by a certain angle in the reverse direction, and it continues to drive the pivoting member to rotate in the reverse direction to look for the relative initial position. Because when the power is off, the pivoting member will rotate relative to the supporting member for various reasons and such rotation will not be recorded by the angle detector, reset in a power-on process is subject to the limiting portion limited by the blocking portion.

According to the present invention, the rotation angle of the pivoting member relative to the supporting member is less than 360 degrees, and when the light fixture receives a reset instruction in a work process, the driver drives the pivoting member to rotate in the forward direction until either the limiting portion is limited by the blocking portion or it is detected for the first time that the angle indicator sends out the indication signal, and then it drives the pivoting member to rotate in the reverse direction to look for the relative initial position. When the light fixture receives the reset instruction in the work process, if it firstly detects that the angle indicator sends out the indication signal for the first time in the process that the driver drives the pivoting member to rotate in the forward direction, a collision between the limiting portion and the blocking portion will not occur so as to realize silent reset.

According to the present invention, the rotation angle of the pivoting member relative to the supporting member is greater than 360 degrees and less than 720 degrees, and when the light fixture receives a reset instruction in a work process, the driver drives the pivoting member to rotate in the forward direction until either the limiting portion is limited by the blocking portion or it is detected twice that the angle indicator sends out the indication signal, and then it drives the pivoting member to rotate in the reverse direction to look for the relative initial position. When the light fixture receives the reset instruction in the work process, if it firstly detects that the angle indicator sends out the indication signal twice in the process that the driver drives the pivoting member to rotate in the forward direction, a collision between the limiting portion and the blocking portion will not occur so as to realize silent reset.

According to the present invention, the limiting portion and the blocking portion do not interfere with each other during rotation of the pivoting member, a pivoting shaft of the pivoting member is sleeved with a shift lever, the shift lever can rotate freely with respect to the pivoting shaft, and both the limiting portion and the blocking portion can abut against the shift lever. In the process that the limiting portion rotates following the pivoting member, the limiting portion does not drive the shift lever to rotate in one circle, but drives the shift lever to rotate in another circle until it is blocked by the blocking portion so as to realize that the rotation angle of the pivoting member relative to the supporting member is greater than 360 degrees and less than 720 degrees.

According to the present invention, the relative initial position of the pivoting member is arranged within an angular range of 15 degrees of rotating in the reverse rotation after the pivoting member rotates in the forward direction until the limiting portion is limited by the blocking portion. Since the angular range is very narrow, in a work process of the light fixture, only when the pivoting member is within a certain small angular range (the range is less than 15 degrees) with respect to the supporting member, and when the reset instruction is received, in the process that the driver drives the pivoting member to rotate in the forward direction, the situation that the limiting portion is limited by the blocking portion occurs firstly, otherwise, it is firstly detected that the angle indicator sends out the indication signal for the first time (the rotation angle of the pivoting member relative to the supporting member is less than 360 degrees) or twice (the rotation angle of the pivoting member relative to the supporting member is greater than 360 degrees and less than 720 degrees), so that in the work process of the light fixture, when the pivoting member is reset, silent reset occurs with a high probability.

According to the present invention, looking for the relative initial position is specifically: in a process of rotation of the pivoting member in the reverse direction, after the pivoting member passes through the specific angular position for the first time, the driver drives the pivoting member to rotate again in the forward direction until the pivoting member passes through the specific angular position for the second time, and a position where the pivoting member is located at the time from generating the indication signal of the angle indicator to ending the indication signal of the angle indicator when the pivoting member passes through the specific angular position for the second time is taken as the relative initial position. When the pivoting member passes through the specific angular position for the first time, the rotation speed of the pivoting member is generally high, at this moment, time for generating and ending the indication signal of the angle indicator cannot be accurately recorded, so after the pivoting member passes through the specific angular position for the first time, the pivoting member rotates again in the forward direction until the pivoting member passes through the specific angular position for the second time, the position where the pivoting member is located at the time from generating the indication signal of the angle indicator to ending the indication signal of the angle indicator in the process is taken as the relative initial position, and the relative initial position is positioned more accurately.

According to the present invention, a detected member of the angle indicator is fixed to the pivoting member. The detected member generally does not need to be connected to a signal line or a power line, and is independent, so that fixing the detected member of the angle indicator to the pivoting member more facilitates routing design.

According to the present invention, the detected member of the angle indicator is a magnetic member, and a detecting member is a magnetic switch. The relative initial position is detected by means of magnetic detection, which can avoid interference from environmental factors.

According to the present invention, a detected member of the angle detector is fixed to the pivoting member. The detected member generally does not need to be connected to a signal line or a power line, and is independent, so that fixing the detected member of the angle detector to the pivoting member more facilitates routing design. Fixing the detected member of the angle detector to the pivoting member enables a structure of the detected member to be designed larger and denser, thereby improving detection precision.

According to the present invention, the detected member of the angle detector is fixed to a rotating shaft of the driver. With respect to fixing the detected member of the angle detector to the pivoting member, it is easier to fix the detected member of the angle detector to the rotating shaft of the driver, and the structure is also smaller.

According to the present invention, the detected member of the angle detector is a photoelectric coded disc, and a detecting element of the angle detector is a photosensitive transceiver. The detection precision is high, and cost is low.

According to the present invention, the pivoting member is a light head of the light fixture, and the supporting member is a supporting at arm of the light fixture.

According to the present invention, the pivoting member can also be a light head and a supporting arm of the light fixture, and the supporting member is a light base of the light fixture.

According to the present invention, at least one of a light beam shading component, a pattern reshaping component, a color rendering component, a focusing lens component, a light splitting component, a frosting component and a magnifying lens component is in the pivoting member to respectively achieve effects of cutting a light beam periphery, reshaping a light beam pattern, rendering light beam color, adjusting a light beam focus, splitting a light beam, homogenizing light of the light beam and magnifying light spots.

DETAILED DESCRIPTION OF THE EMBODIMENTS

The accompanying drawings are only for illustrative descriptions and cannot be understood as a limitation to the patent. In order to better illustrate the embodiment, some parts of the accompanying drawings may be omitted, enlarged or reduced, and do not represent a size of an actual product; and it is understandable for those skilled in the art that some well-known structures in the accompanying drawings and their descriptions may be omitted. The positional relationships depicted in the accompanying drawings are only for illustrative descriptions and cannot be understood as a limitation to the patent.

Figure 1:
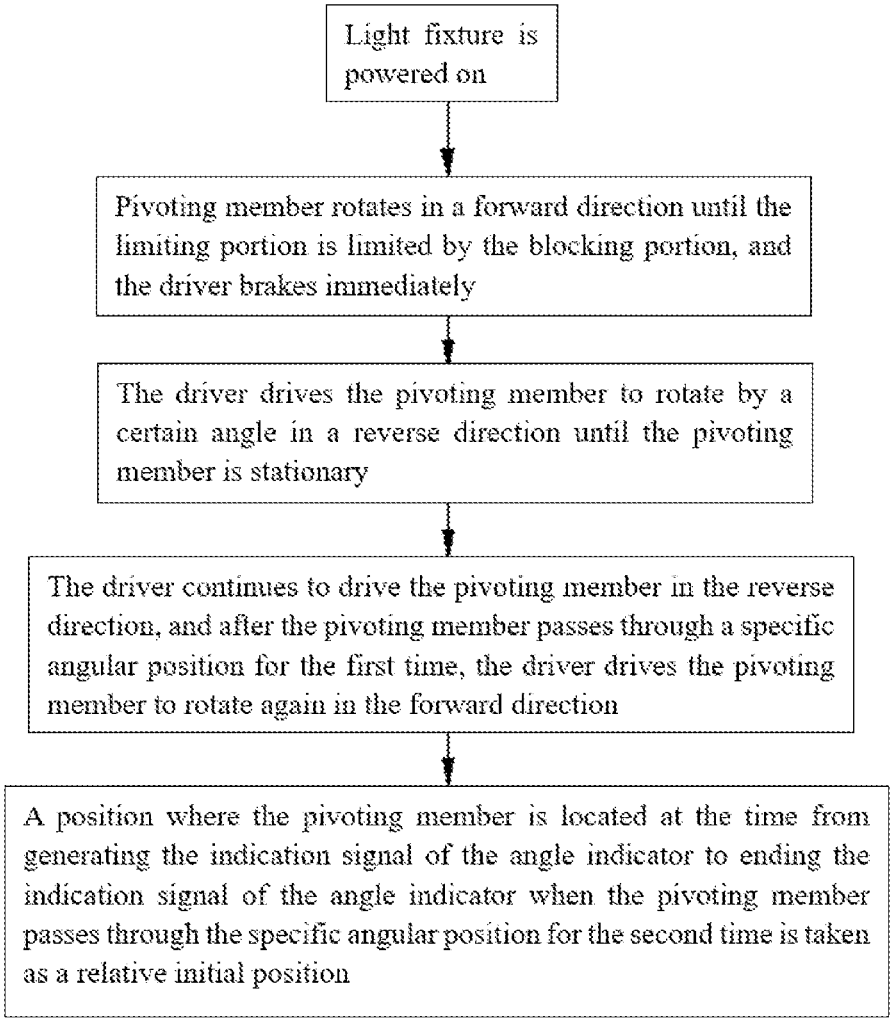
FIG. 1 is a flow chart of power-on reset of a light fixture according to the present invention.
Figure 2:
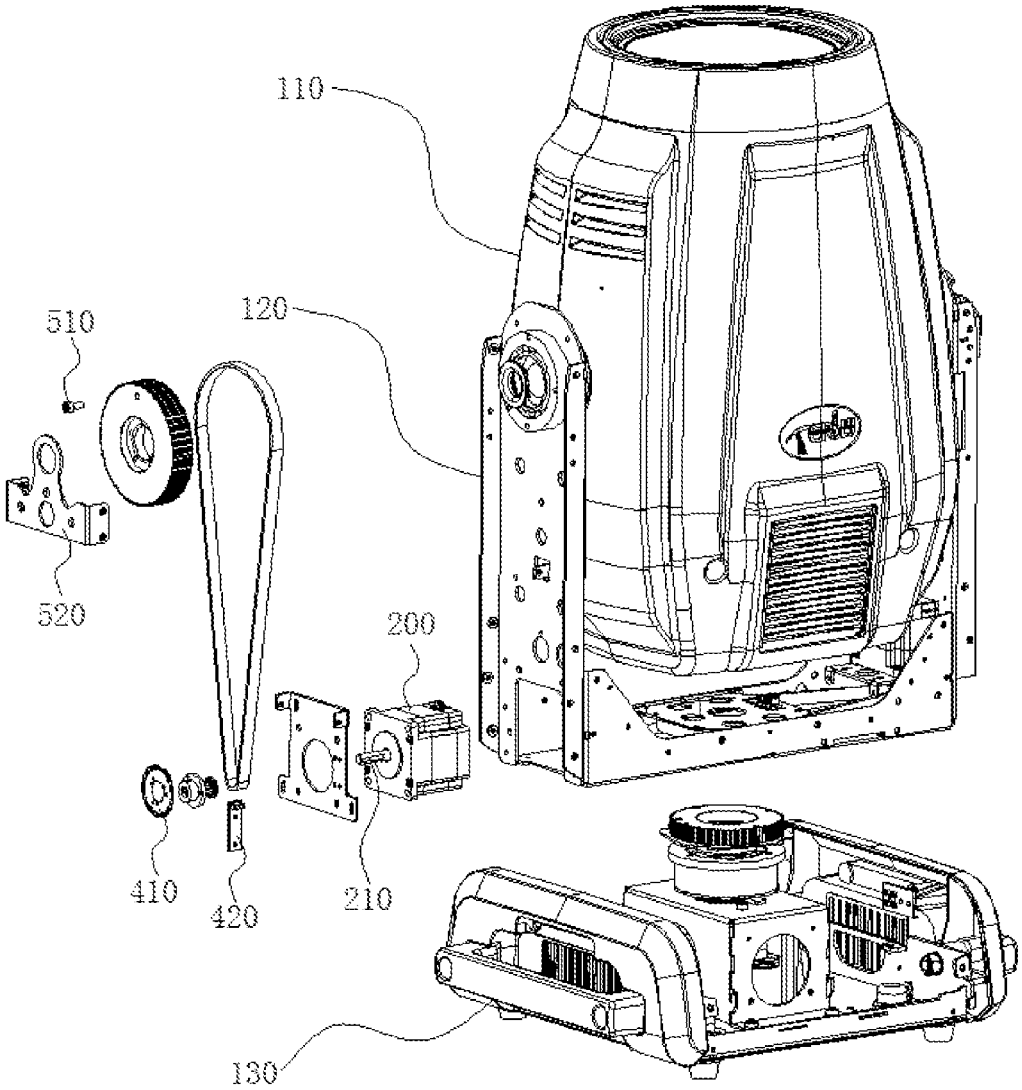
FIG. 2 is a structural schematic diagram of an embodiment according to the present invention.

As in FIG. 1 and FIG. 2, a low-noise reset control system of a light fixture is provided according to an embodiment, including a supporting member, a pivoting member pivoted to the supporting member, and a driver 200 driving the pivoting member to rotate relative to the supporting member. The pivoting member includes at least one light source for generating a lighting effect. A limiting portion 510 is al ranged on the pivoting member, and a blocking portion 520 matched with the limiting portion 510 to limit a rotation angle of the pivoting member is arranged on the supporting member. The low-noise reset control system further includes an angle detector configured to sense a rotation angle of the pivoting member and an angle indicator configured to send out an indication signal when the pivoting member is at a specific angular position relative to the supporting member, and when the pivoting member rotates by one circle relative to the supporting member, the angle indicator sends out the indication signal only once. In a reset process of the light fixture, when the pivoting member rotates in a forward direction until the limiting portion 510 is blocked by the blocking portion 520, the driver 200 brakes immediately, and after the pivoting member is driven to rotate by a certain angle in a reverse direction at a low speed, then the speed is increased to continue to drive the pivoting member to rotate in the reverse direction to look for a relative initial position.

The low-noise reset control system according to the present embodiment determines an absolute initial position through cooperation of the limiting portion 510 and the blocking portion 520, and then confirms a relative initial position using the angle indicator. A rotation angle of the pivoting member is recorded through the angle detector. When the pivoting member rotates in the forward direction until the limiting portion 510 is blocked by the blocking portion 520, the driver 200 brakes immediately, so that a rotation speed of the pivoting member decreases to avoid that the limiting portion 510 repeatedly collides with the blocking portion 520 to cause noise. Then the pivoting member is driven to rotate by a certain angle in the reverse direction at a low speed so that a transmission member between the driver 200 and the pivoting member is loosened and vibration of the pivoting member is weakened, avoiding inaccurate positioning for the relative initial position later, and then the speed is increased to continue to drive the pivoting member in the reverse direction to look for the relative initial position so as to complete reset of the light fixture, which is free of noise caused during repeated collisions and can also ensure the positioning accuracy of the initial position.

In the present embodiment, after the driver 200 brakes immediately, the pivoting member is driven to rotate by a certain angle in the reverse direction until the pivoting member is stationary, that is the speed decreases to 0, and then it continues to drive the pivoting member to rotate in the reverse direction to look for the relative initial position. With such configuration, the transmission member between the driver 200 and the pivoting member is completely loosened and the vibration of the pivoting member is completely dissipated, thereby ensuring more accurate positioning in looking for the relative initial position of the pivoting member later.

According to the embodiment, when power-on reset is conducted, no matter whether the indication signal is detected in the process, the pivoting member rotates in the forward direction until the limiting portion 510 is limited by the blocking portion 520, then the driver 200 brakes and drives the pivoting member to rotate by a certain angle in the reverse direction, and it continues to drive the pivoting member to rotate in the reverse direction to look for the relative initial position. Because when the power is off, the pivoting member will rotate relative to the supporting member for various reasons, such as the action of gravity or manual pulling, and such rotation will not be recorded by the angle detector, power-on reset process is subject to the limiting portion 510 limited by the blocking portion 520, resulting in more accurate reset.

Figure 3:
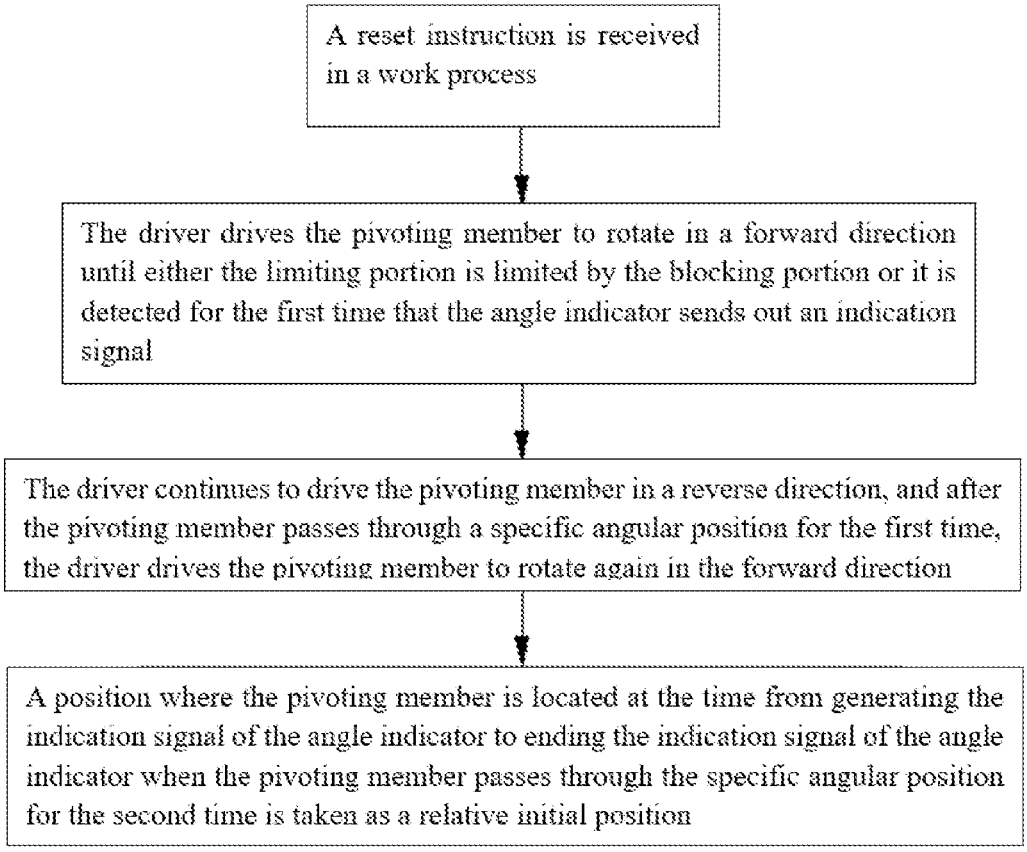
FIG. 3 is a flow chart of reset in a work process of a light fixture of the embodiment according to the present invention.

As in FIG. 3, according to the embodiment, the rotation angle of the pivoting member relative to the supporting member is less than 360 degrees, and when the light fixture receives a reset instruction in a work process, the driver 200 drives the pivoting member to rotate in the forward direction until either the limiting portion 510 is limited by the blocking portion 520 or it is detected for the first time that the angle indicator sends out the indication signal, and then it drives the pivoting member to rotate in the reverse direction to look for the relative initial position. When the light fixture receives the reset instruction in the work process, if it firstly detects that the angle indicator sends out the indication signal for the first time in the process that the driver 200 drives the pivoting member to rotate in the forward direction, a collision between the limiting portion 510 and the blocking portion 520 will not occur so as to realize silent reset. If the limiting portion 510 is blocked by the blocking portion 520 firstly, the driver 200 brakes immediately, and after the pivoting member is driven to rotate by a certain angle in the reverse direction at a low speed, the speed is increased to continue to drive the pivoting member to rotate in the reverse direction to look for the relative initial position, at this moment, collision occurs only once. Preferably, the pivoting member is a light head 110 of a stage light fixture and the supporting member is a supporting arm 120 of the stage light fixture.

Figure 4:
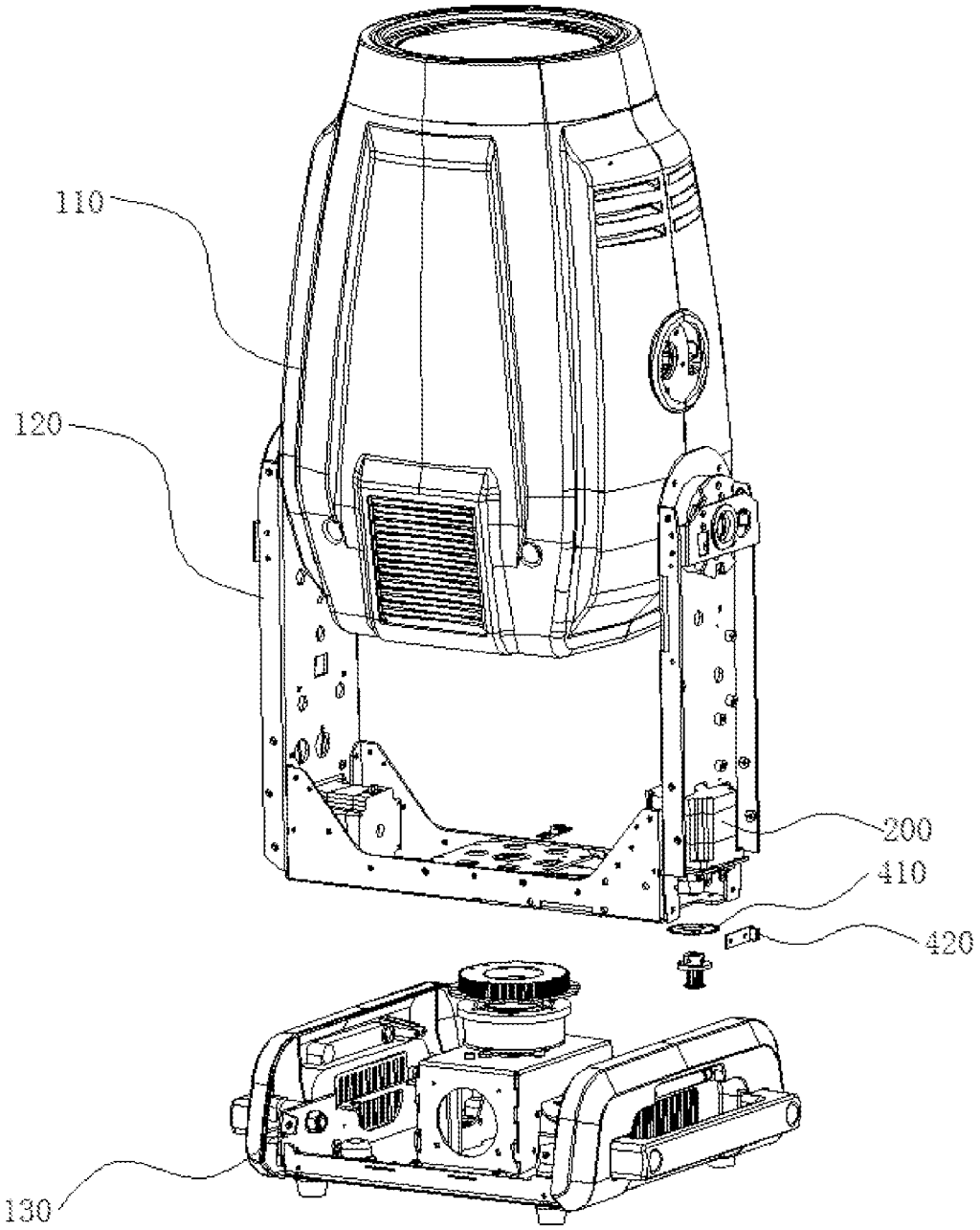
FIG. 4 is a schematic diagram of an overall structure of another embodiment according to the present invention.
Figure 5:
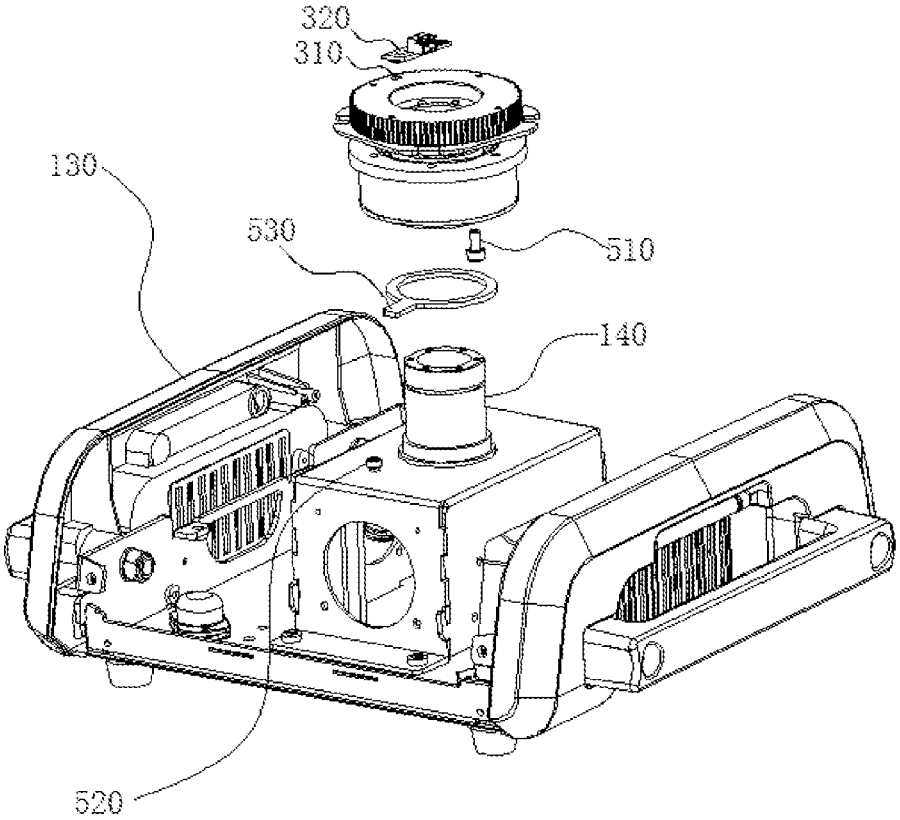
FIG. 5 is a structural schematic diagram of a light base of the embodiment according to the present invention.

As in FIG. 4 and FIG. 5, according to this embodiment, the rotation angle of the pivoting member relative to the supporting member is greater than 360 degrees and less than 720 degrees, and when the light fixture receives a reset instruction in a work process, the driver 200 drives the pivoting member to rotate in the forward direction until either the limiting portion 510 is limited by the blocking portion 520 or it is detected twice that the angle indicator sends out the indication signal, and then it drives the pivoting member to rotate in the reverse direction to look for the relative initial position. When the light fixture receives the reset instruction in the work process, if it firstly detects that the angle indicator sends out the indication signal twice in the process that the driver 200 drives the pivoting member to rotate in the forward direction, a collision between the limiting portion 510 and the blocking portion 520 will not occur so as to realize silent reset. If the limiting portion 510 is blocked by the blocking portion 520 first, the driver 200 brakes immediately, and after the pivoting member is driven to rotate by a certain angle in the reverse direction at a low speed, the speed is increased to continue to drive the pivoting member to rotate in the reverse direction to look for the relative initial position, at this moment, collision occurs only once. Preferably, in this embodiment, the pivoting member is a light head 110 and a supporting arm 120 of a stage light fixture and the supporting member is a light base 130 of the stage light fixture.

According to the present embodiment, referring to FIG. 5, the limiting portion 510 and the blocking portion 520 do not interfere with each other during rotation of the pivoting member. A pivoting shaft 140 of the pivoting member is sleeved with a shift lever 530, the shift lever 530 can rotate freely with respect to the pivoting shaft 140, and both the limiting portion 510 and the blocking portion 520 can abut against the shift lever 530. In the process that the limiting portion 510 rotates following the pivoting member, the limiting portion does not drive the shift lever 530 to rotate in one circle, but drives the shift lever 530 to rotate in another circle until it is blocked by the blocking portion 520 so as to realize that the rotation angle of the pivoting member relative to the supporting member is greater than 360 degrees and less than 720 degrees.

In the embodiment, the relative initial position of the pivoting member is arranged within an angular range of 15 degrees of rotating in the reverse rotation after the pivoting member rotates in the forward direction until the limiting portion 510 is limited by the blocking portion 520. Since the angular range is very narrow, in the work process of the light fixture, only when the pivoting member is within a certain small angular range (the range is less than 15 degrees) with respect to the supporting member, and when the reset instruction is received, in the process that the driver 200 drives the pivoting member to rotate in the forward direction, the situation that the limiting portion 510 is limited by the blocking portion 520 occurs firstly, otherwise, it is firstly detected that the angle indicator sends out the indication signal for the first time (the rotation angle of the pivoting member relative to the supporting member is less than 360 degrees) or twice (the rotation angle of the pivoting member relative to the supporting member is greater than 360 degrees and less than 720 degrees), so that in the work process of the light fixture, when the pivoting member is reset, silent reset occurs with a high probability.

According to other embodiments, the range of the rotation angle of the pivoting member relative to the supporting member can be greater. When the light fixture receives the reset instruction in the work process, if it firstly detects that the angle indicator sends out the indication signal N+1 times in the process that the driver 200 drives the pivoting member to rotate in the forward direction, wherein N is an integer obtained by dividing the maximum rotation angle of the pivoting member by 360, then a collision between the limiting portion 510 and the blocking portion 520 will not occur so as to achieve silent reset.

In the embodiment, looking for the relative initial position is specifically: in a process of rotation of the pivoting member in the reverse direction, after the pivoting member passes through the specific angular position for the first time, the driver 200 drives the pivoting member to rotate again in the forward direction until the pivoting member passes through the specific angular position for the second time, and a position where the pivoting member is located at the time from generating the indication signal of the angle indicator to ending the indication signal of the angle indicator when the pivoting member passes through the specific angular position for the second time is taken as the relative initial position. When the pivoting member passes through the specific angular position for the first time, the rotation speed of the pivoting member is generally high, at this moment, time for generating and ending the indication signal of the angle indicator cannot be accurately recorded, so after the pivoting member passes through the specific angular position for the first time, the pivoting member rotates in the forward direction again until the pivoting member passes through the specific angular position for the second time, the position where the pivoting member is located at the time from generating the indication signal of the angle indicator to ending the indication signal of the angle indicator in the process is taken as the relative initial position, and the relative initial position is positioned more accurately.

In the embodiment, a detected member of the angle indicator is fixed to the pivoting member. The detected member generally does not need to be connected to a signal line or a power line, and is independent, so that fixing the detected member of the angle indicator to the pivoting member more facilitates routing design. Optionally, the detected member of the angle indicator is fixed to the pivoting shaft 140 of the pivoting member.

In the embodiment, the detected member of the angle indicator is a magnetic member 310, and a detecting member is a magnetic switch 320. The relative initial position is detected by means of magnetic detection, which can avoid interference from environmental factors. In other embodiments, the angle indicator may also be a mechanical switch or a photoelectric switch.

In the embodiment, a detected member of the angle detector is fixed to the pivoting member. The detected member generally does not need to be connected to a signal line or a power line, and is independent, so that fixing the detected member of the angle detector to the pivoting member more facilitates routing design. Fixing the detected member of the angle detector to the pivoting member enables a structure of the detected member to be designed larger and denser, thereby improving detection precision. Optionally, the detected member of the angle detector is fixed to the pivoting shaft 140 of the pivoting member.

In the embodiment, the detected member of the angle detector is fixed to a rotating shaft 210 of the driver 200. With respect to fixing the detected member of the angle detector to the pivoting member, it is easier to fix the detected member of the angle detector to the rotating shaft 210 of the driver 200, and the structure is also smaller.

In the embodiment, the detected member of the angle detector is a photoelectric coded disc 410, and a detecting element of the angle detector is a photosensitive transceiver 420. The detection precision is high, and cost is low. In other embodiments, the angle detector may also be a resistive angle sensor, a capacitive angle sensor, a Hall-type angle sensor, a photoelectric angle sensor or an infrared angle sensor, etc. and is not limited to a magnetic encoding type angle sensor.

In the embodiment, the limiting portion 510 and the blocking portion 520 are respectively formed by studs fixed to the pivoting member and the supporting member.

In the embodiment, at least one of a light beam shading component, a pattern reshaping component, a color rendering component, a focusing lens component, a light splitting component, a frosting component and a magnifying lens component is in the pivoting member. The foregoing components are generally located in the light head 110 of the stage light fixture to respectively achieves effects of cutting a light beam periphery, reshaping a light beam pattern, rendering light beam color, adjusting a light beam focus, splitting a light beam, homogenizing light of the light beam and magnifying light spots.

Obviously, the above-mentioned embodiments of the present invention are merely examples to clearly illustrate the present invention, and are not intended to limit the implementation modes of the present invention. For those of ordinary skill in the art, other changes or modifications in different forms can also be made on the basis of the above description. It is unnecessary and impossible to list all the implementation modes here. Any modification, equivalent replacement, improvement and the like made within the spirit and principle of the present invention shall be included in the protection scope of the claims of the present invention.

The invention claimed is:

1. A low-noise reset control system of a light fixture, comprising:

a supporting member, on which a blocking portion is arranged;

a pivoting member pivoted to the supporting member, which has at least one light source for generating a lighting effect, and on which a limiting portion is arranged, wherein the blocking portion is configured to cooperate with the limiting portion to limit a rotation angle of the pivoting member;

a driver driving the pivoting member to rotate relative to the supporting member;

an angle detector configured to sense the rotation angle of the pivoting member; and an angle indicator configured to send out an indication signal when the pivoting member is at a specific angular position relative to the supporting member, and configured to merely send out the indication signal once during rotation of the pivoting member relative to the supporting member for one circle, wherein the driver is configured to brake immediately and drive the pivoting member to rotate by a certain angle in a reverse direction at a low speed, then to increase speed and continue to drive the pivoting member to rotate in the reverse direction to look for a relative initial position, in a reset process of the light fixture, when the pivoting member rotates in a forward direction until the limiting portion is blocked by the blocking portion; the relative initial position is confirmed by the angle indicator.

2. The low-noise reset control system according to claim 1, wherein the driver is configured to drive the pivoting member to rotate by a certain angle in the reverse direction until the pivoting member is stationary and continues to drive the pivoting member to rotate in the reverse direction to look for the relative initial position, after the driver brakes immediately.

3. The low-noise reset control system according to claim 1, wherein when a power-on reset of the light fixture is conducted, the pivoting member rotates in the forward direction until the limiting portion is limited by the blocking portion, then the driver brakes and drives the pivoting member to rotate by the certain angle in the reverse direction, and it continues to drive the pivoting member to rotate in the reverse direction to look for the relative initial position.

4. The low-noise reset control system according to claim 1, wherein the rotation angle of the pivoting member relative to the supporting member is less than 360 degrees, and when the light fixture receives a reset instruction in a work process, the driver drives the pivoting member to rotate in the forward direction until either the limiting portion is limited by the blocking portion or it is detected for the first time that the angle indicator sends out the indication signal, and then it drives the pivoting member to rotate in the reverse direction to look for the relative initial position.

5. The low-noise reset control system according to claim 1, wherein the rotation angle of the pivoting member relative to the supporting member is greater than 360 degrees and less than 720 degrees, and when the light fixture receives a reset instruction in a work process, the driver drives the pivoting member to rotate in the forward direction until either the limiting portion is limited by the blocking portion or it is detected twice that the angle indicator sends out the indication signal, and then it drives the pivoting member to rotate in the reverse direction to look for the relative initial position.

6. The low-noise reset control system according to claim 1, wherein the relative initial position of the pivoting member is defined within an angular range of 15 degrees of rotating in the reverse direction after the pivoting member rotates in the forward direction until the limiting portion is limited by the blocking portion.

7. The low-noise reset control system according to claim 1, wherein the limiting portion and the blocking portion do not interfere with each other in rotation of the pivoting member, a pivoting shaft of the pivoting member is sleeved with a shift lever, the shift lever is able to rotate freely with respect to the pivoting shaft, and both the limiting portion and the blocking portion are capable of abutting against the shift lever.

8. The low-noise reset control system according to claim 1, wherein the relative initial position is specifically defined in a way that: in rotation of the pivoting member in the reverse direction, after the pivoting member passes through the specific angular position for the first time, the driver drives the pivoting member to rotate again in the forward direction until the pivoting member passes through the specific angular position for the second time, and a position where the pivoting member is located at the time from generating the indication signal of the angle indicator to ending the indication signal of the angle indicator when the pivoting member passes through the specific angular position for the second time is taken as the relative initial position.

9. The low-noise reset control system according to claim 1, wherein a detected member of the angle indicator is fixed to the pivoting member.

10. The low-noise reset control system according to claim 1, wherein a detected member of the angle indicator is a magnetic member, and a detecting member is a magnetic switch.

11. The low-noise reset control system according to claim 1, wherein a detected member of the angle detector is fixed to the pivoting member.

12. The low-noise reset control system according to claim 1, wherein a detected member of the angle detector is fixed to a rotating shaft of the driver.

13. The low-noise reset control system according to claim 1, wherein a detected member of the angle detector is a photoelectric coded disc, and a detecting element of the angle detector is a photosensitive transceiver.

14. The low-noise reset control system according to claim 1, wherein the pivoting member comprises a light head of the light fixture, and the supporting member comprises a supporting arm of the light fixture.

15. The low-noise reset control system according to claim 1, wherein the pivoting member comprises a light head and a supporting arm of the light fixture, and the supporting member comprises a light base of the light fixture.

16. The low-noise reset control system according to claim 1, wherein at least one of a light beam shading component, a pattern reshaping component, a color rendering component, a focusing lens component, a light splitting component, a frosting component and a magnifying lens component is provided in the pivoting member.

17. A low-noise reset control method for a light fixture, wherein when a pivoting member rotates relative to a supporting member in a forward direction to a limiting portion being blocked by a blocking portion, immediately braking a driver and driving the pivoting member by the driver to rotate by a certain angle in a reverse direction at a low speed, then increasing speed and continuing to drive the pivoting member to rotate in the reverse direction to look for a relative initial position.

18. The low-noise reset control method for the light fixture according to claim 17, in power-on reset, the method comprising: driving the pivoting member by the driver to rotate in the forward direction until the limiting portion is limited by the blocking portion, braking the driver and diving the pivoting member by the driver to rotate by the certain angle in the reverse direction, and continuing to drive the pivoting member to rotate in the reverse direction to look for the relative initial position.

19. The low-noise reset control method for the light fixture according to claim 17, in reset during working of the light fixture, in a case that a rotation angle of the pivoting member relative to the supporting member is less than 360 degrees, the method comprising:

driving the pivoting member by the driver to rotate in the forward direction until either the limiting portion is limited by the blocking portion or the angle indicator sends out the first indication signal, and then driving the pivoting member to rotate in the reverse direction to look for the relative initial position.

20. The low-noise reset control method for the light fixture according to claim 17, in reset during working of the light fixture, in a case that a rotation angle of the pivoting member relative to the supporting member is greater than 360 degrees and less than 720 degrees, the method comprising:

driving the pivoting member by the driver to rotate in the forward direction until either the limiting portion is limited by the blocking portion or the angle indicator sends out the indication signal twice, and then driving the pivoting member to rotate in the reverse direction to look for the relative initial position.

* * * * *